US006545558B2

(12) United States Patent
Hasegawa

(10) Patent No.: US 6,545,558 B2
(45) Date of Patent: Apr. 8, 2003

(54) NONRECIPROCAL CIRCUIT COMPONENT AND COMMUNICATION DEVICE WITH A RESIN MEMBER HAVING ELECTRODE-THICK CONVEXITY

(75) Inventor: Takashi Hasegawa, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/042,041

(22) Filed: Oct. 25, 2001

(65) Prior Publication Data

US 2002/0067219 A1 Jun. 6, 2002

(30) Foreign Application Priority Data

Oct. 26, 2000 (JP) ..... 2000-326747

(51) Int. Cl.[7] ..... H01P 1/36; H01P 1/383

(52) U.S. Cl. ..... 333/1.1; 333/24.2

(58) Field of Search ..... 333/1.1, 24.2; H01P 1/36, 1/383

(56) References Cited

FOREIGN PATENT DOCUMENTS

JP 09-326604 A * 12/1997 ..... H01P/1/383
JP 11-097911 A * 4/1999 ..... H01P/1/383

* cited by examiner

*Primary Examiner*—Justin P. Bettendorf
(74) *Attorney, Agent, or Firm*—Keating & Bennett, LLP

(57) ABSTRACT

A resin member is arranged between a permanent magnet, and a resistance element and a matching capacitor or the like. The ports of center electrodes are electrically connected to the resistance element and the matching capacitor element on the top faces of the resistance element and the matching capacitor element. A convexity of which the height is substantially equal to the electrode thickness of the ports of the center electrodes is formed on the under face of the resin member.

14 Claims, 8 Drawing Sheets

NONRECIPROCAL CIRCUIT COMPONENT AND COMMUNICATION DEVICE WITH A RESIN MEMBER HAVING ELECTRODE-THICK CONVEXITY

BACKGROUND OF THE INVENTION

1. Field of the Invention

The present invention relates to an irreversible circuit device and a communication device.

2. Description of the Related Art

Generally, lumped-constant isolators (irreversible circuit devices) employed in mobile communication devices such as portable telephones or the like have a function of allowing a signal to pass only in the transmission direction and blocking the transmission of a signal in the reverse direction. Moreover, for recent mobile communication devices, high reliability and low cost have been more required, due to the type of the uses. Accordingly, for the lumped-constant isolators, higher reliability and lower cost have been strongly required.

The above-described lumped-constant isolators each comprise a permanent magnet, a ferrite to which a DC magnetic field is applied, a plurality of center electrodes arranged on the ferrite, a resin member arranged between the permanent magnet and a capacitor element for matching, an upper case made of a magnetic metal and accommodating the permanent magnet, the ferrite, and the center electrodes, a lower case made of a magnetic metal, and so forth.

FIG. 14 is a vertical cross-sectional view of a part of this isolator in which a resistance element and the matching capacitor element are arranged. In an isolator 200, a matching capacitor element C and a resistance element R are soldered in a lower case 5 formed integrally with a resin case 3. Center electrodes P are arranged on the top faces of the matching capacitor element C and the resistance element R. The matching capacitor element C and the resistance element R are electrically connected to the center electrodes P. A resin member 230 is arranged so as to cover the matching capacitor element C, the resistance element R, and the central electrodes P. The under face of a resin member 230 is formed so as to be flat. Reference numerals 8 and 9 designate an upper case and a permanent magnet, respectively.

In this case, the resin member 230, and the resistance element R and the matching capacitor element C compactly sandwich the central electrodes P. The reasons lie in that the number of the assembling processes is reduced, and a so-called chip-rising phenomenon is prevented when the resistance element R and the matching capacitor element C are soldered.

Referring to the structure of the isolator 200, the resistance element R, the matching capacitor element C, and the center electrodes P are electrically connected to each other on the top faces of the resistance element R and the matching capacitor element C. The resin member 230 locally presses the top faces of the center electrodes P. Accordingly, the pressure used when the isolator 200 is assembled, that is, the permanent magnet 9 is mounted, and the upper case 8 is made to cover, is transmitted to inner components such as the resistance element R and the matching capacitor element C via the resin member 230 and the center electrodes P. Thus, the pressure concentrats onto the parts of the resistance element R and the matching capacitor element C which contact the center electrodes P. In some cases, these inner components are broken. Specially, when the inner components are resistance elements, capacitor elements for matching, or the like made of a ceramic material, problems arise in that these components are ready to be broken.

In the case in which a part (a terminal electrode 211 on the high temperature side of the resistance element R) of the under face of the resistance element R is arranged on the resin case 3, a space e is formed above the terminal electrode 210 on the ground side electrically connected to the lower case 4, corresponding to the thickness of the central electrodes P. Accordingly, when the pressure is applied to the resistance element R, the terminal electrode 211 on the high temperature side of the resistance element R encroaches on the resin of the resin case 3. On the other hand, the terminal electrode 210 on the ground side is lifted from the lower case 4. This causes a problem in that the isolator 200 is unsuitably opened.

SUMMARY OF THE INVENTION

Accordingly, it is an object of the present invention to provide an irreversible circuit component of which the structure is easy to be assembled and handled, and the reliability is high.

To achieve the above-described object of the present invention, according to the present invention, there is provided an irreversible circuit component comprising a permanent magnet, a ferrite to which the permanent magnet applies a DC magnetic field, plural center electrodes arranged on the ferrite, an internal component, a resin member arranged between the permanent magnet and the internal component, a metal case accommodating the permanent magnet, the ferrite, the center electrodes, the resin member, and the internal component, the internal component and the center electrodes being electrically connected to each other on the top face of the internal component, the main face near the internal component of the resin member being provided with a step of which the size is substantially equal to the thickness of the center electrodes electrically connected to the internal component.

The internal component is a resistance element, a matching capacitor element, or the like. A part of the under face of the internal component may contact the inner wall of a resin case formed integrally with the metal case. Moreover, the size of the step is preferably in the range of 10 $\mu$m to 100 $\mu$m. The main face near the internal component of the resin member may be provided with a concavity of which the size is such that the concavity can cover at least a part of the internal component. Furthermore, preferably, the internal component is electrically connected to the center electrodes via solder. Moreover, the distance in the thickness direction of the resin member between the internal component and the resin member is preferably up to 200 $\mu$m, and the distance in the thickness direction of the resin member between the center electrodes and the resin member is preferably up to 200 $\mu$m.

With the above-described structure, the top face of the internal component can contact not only the center electrodes but also the main face of the resin member, due to the step provided on the main face near the internal component of the resin member. Accordingly, the pressure used when the permanent magnet is mounted, and the metal case is made to cover is divided into the pressure applied to the internal component via the center electrodes and the pressure applied directly to the internal component. As a result, the pressure is dispersed and applied to the whole internal component. Thus, breaking of the internal component is prevented.

Preferably, the resin member is made of one material of a liquid crystal polymer and PPS. The liquid crystal polymer and PPS are superior in high heat resistance and low loss. Thus, the irreversible circuit component having a high reliability can be provided.

The communication device in accordance with the present invention includes the irreversible circuit component having the above-described characteristics. Thus, the communication device of which the cost is low and the reliability is high can be provided.

DESCRIPTION OF THE EMBODIMENTS

Figure 1:
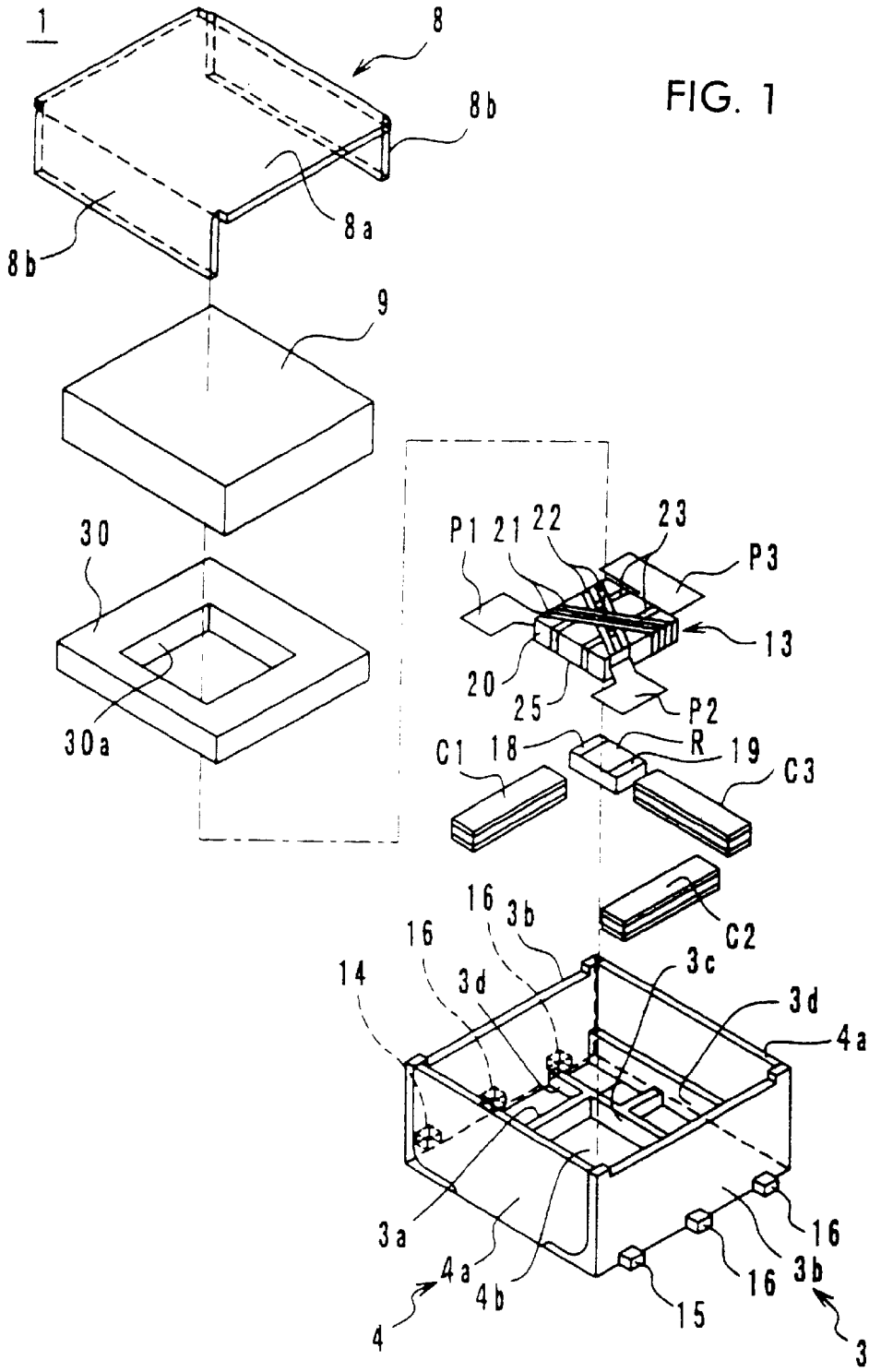
FIG. 1 is an exploded perspective view of a irreversible circuit component according to an embodiment of the present invention.

Hereinafter, embodiments of an irreversible circuit component according to the present invention will be described with reference to the accompanying drawings. In the respective embodiments, the same parts or portions are designated by the same reference numerals, respectively, and the repeated description is omitted.

First Embodiment

Figure 2:
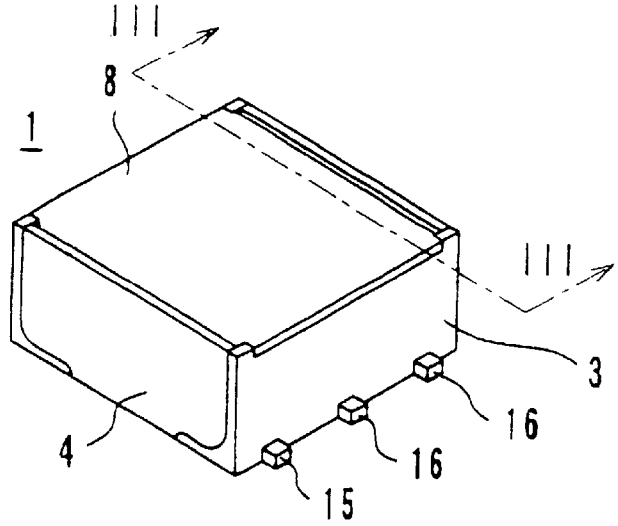
FIG. 2 is a perspective view illustrating assembling the irreversible circuit component shown in FIG. 1.

FIG. 1 is an exploded perspective view showing the structure of an irreversible circuit component according to a first embodiment of the present invention. FIG. 2 is a perspective view showing the appearance of the irreversible circuit component 1 of FIG. 1 after the assembly is completed. The irreversible circuit component 1 is a lumped-constant isolator.

The lumped-constant isolator 1 comprises the upper case 8 made of magnetic metal, the lower case 4 made of magnetic metal, the resin case 3, a center electrode assemblage 13, the permanent magnet 9, the resistance element R, and the matching capacitor elements C1 to C3, and a resin member 30.

The lower case 4 comprises side walls 4*a* on the right and left hand sides, and the bottom wall 4*b*. The lower case 4 is formed integrally with the resin case 3 by insert-molding process. Two ground terminals 16 are provided so as to extend from each of one paired sides opposed to each other of the bottom wall 4*b* of the lower case 4. Moreover, the upper case 8 has a rectangular shape in the plan view thereof, and comprises the upper wall 8*a* and the side walls 8*b* on the right and left sides. The lower case 4 and the upper case 8 are formed by punching a sheet material with a high magnetic permeability, e.g., made of Fe or silicon steel, bending and plating the surface with Cu or Ag.

As regards the center electrode assemblage 13, three center electrode 21 to 23 are arranged so as to intersect substantially every 120° interval on the top side of a rectangular-shaped microwave ferrite 20 with an insulating sheet (not shown) being interposed between them. The center electrodes 21 to 23 have ports P1 to P3 on the one-end sides thereof extending in the horizontal direction. Moreover, a common ground electrode 25 for the center electrodes 21 to 23 on the other-end sides is formed so as to contact the under side of the ferrite 20. The common ground electrode 25 substantially covers the under side of the ferrite 20, extends through a window 3*c* of the resin case 3, which will be described later, and is connected to the bottom wall 4*b* of the lower case 4 and grounded by soldering or the like. The center electrodes 21 to 23 and the ground electrode 25 are made of a conductive material such as Ag, Cu, Au, Al, Be, or the like, and are formed integrally with each other by punching a metal thin-sheet, etching, and so forth.

The resin case 3 is made of an electrically insulating resin, and has a bottom 3*a* land two sides 3*b*. A rectangular window 3*c* is formed in the center of the bottom 3*a*. Windows 3*d* for accommodating the matching capacitor elements C1 to C3 and the resistance element R are formed in the periphery of the window 3*c*. The bottom wall 4*b* of the lower case 4 are exposed to the windows 3*c* and 3*d*. An input terminal 14 and an output terminal 15 are insert-molded with the resin case 3. One end of each of the input and output terminals 14 and 15 is exposed to the outer surface of the resin case 3, while the other end is exposed to the inner surface of the resin case 3. The ground terminals 16 are projected outward from the outer faces opposed to each other of the resin case 3. As material for the resin case 3, for example, liquid crystal polymers, PPS, plastics, and the like are used.

Referring to the matching capacitor elements C1 to C3, the capacitor electrodes on the high temperature sides, which position on the top sides of dielectric ceramic substrates, are electrically connected to the ports P1 to P3, respectively, and the capacitor electrodes on the low temperature sides (ground sides) are soldered to the bottom 4*b* of the lower case 4 exposed to the widows 3*d* of the resin case 3, respectively.

Figure 3:
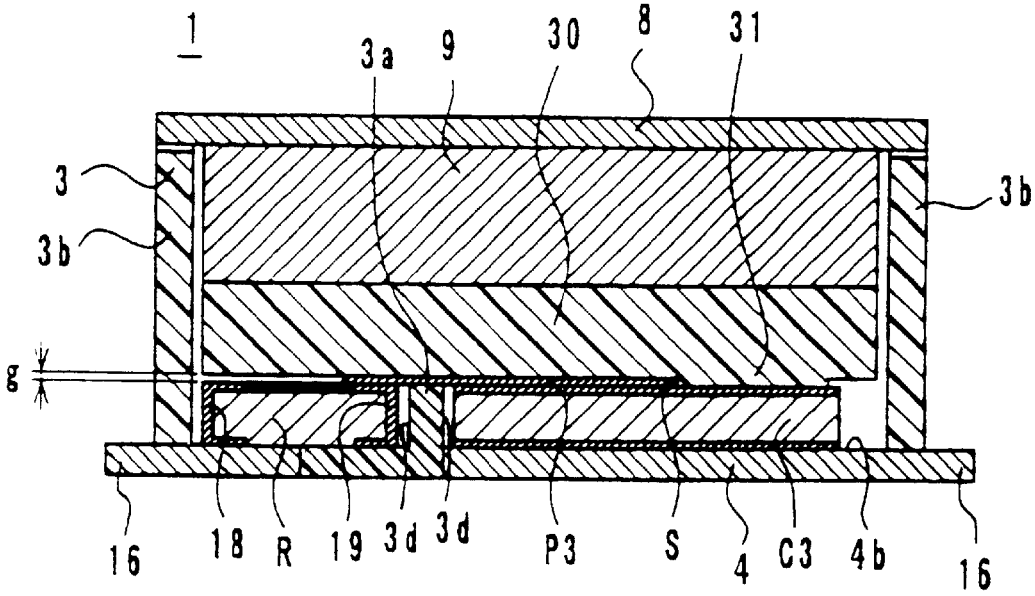
FIG. 3 is a cross-sectional view of the irreversible circuit component taken along line III—III in FIG. 2.
Figure 4:
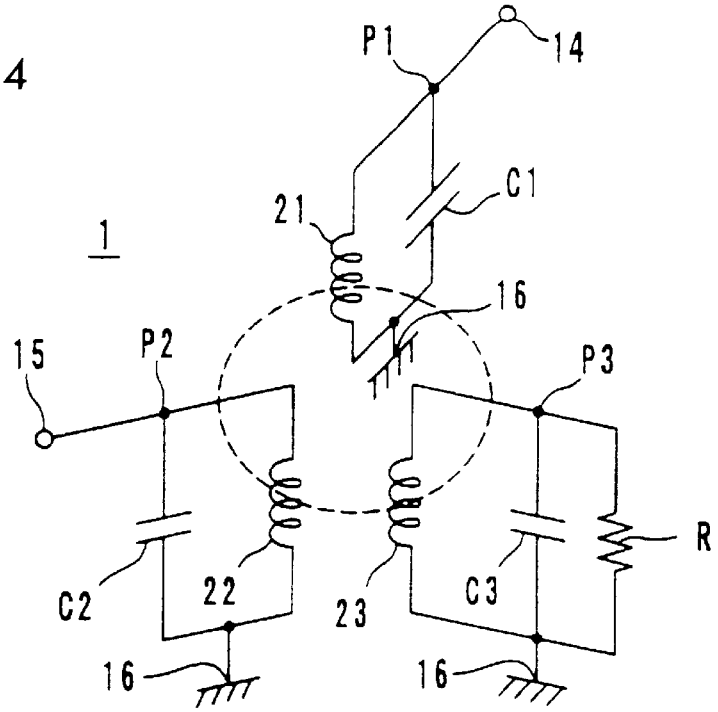
FIG. 4 is an electrical equivalent circuit diagram of the irreversible circuit component shown in FIG. 1.

Referring to the resistance element R, as shown in FIG. 3, the terminal electrode 18 on the ground side and the terminal electrode 19 on the high temperature side are formed on both ends of an insulating substrate by thick-film printing or the like. A resistor comprising a thick film made of a cermet type, a carbon type, a ruthenium type, or the like, or a metal thin film is arranged between the terminal electrodes 18 and 19. As a material for the insulating substrate, for example, dielectric ceramics such as alumina or the like are used. A coating film made of glass or the like may be formed on the surface of the resistor. The terminal electrode 18 on the ground side is soldered to the bottom wall 4*b* of the lower case 4 exposed to the windows 3*d* of the resin case 3. The terminal electrode 19 on the high temperature side is soldered to the port P3 of the center electrode 23 on the top face of the resistance element R. That is, the matching capacitor element C3 and the resistance element R are electrically connected in parallel to each other between the port P3 of the center electrode 23 and the ground terminal 16, as shown in FIG. 4.

As the solder, Sn—Sb type, Sn—Pb type, or Sn—Ag type solder is used. Specially, a non-lead type solder, that is, the Sn—Sb type solder having a high melting point is preferably used from the standpoint of the prevention of environmental contamination and the reflow soldering properties of the irreversible circuit component 1.

A resin member 30 is arranged on the resistance element R and the matching capacitor elements C1 to C3, as shown in FIG. 1. A hole 30*a* for accommodating the center electrode assemblage 13 is formed in the center of the resin member 30 to reduce the height of the isolator 1. In this embodiment, the hole 30*a* is provided in the center of the resin member 30. However, the hole 30*a* is not necessarily provided. As a material for the resin member 30, liquid crystal polymers or PPS (polyphenylene sulfide resin) is preferably used, since the liquid crystal polymers and PPS are superior in heat resistance and low loss.

As shown in FIG. 3, a convexity 31 having a height substantially equal to the electrode thickness of the port P3 of the center electrode 23 is formed in the outer periphery on the under face of the resin member 30. The thickness of the center electrodes 21 to 23 is set at about 10 to 100 $\mu$m (center value: 30 to 50 $\mu$m) from the standpoint of the height of a product, vibration resistance, feasibility for assembly, insertion loss, and so forth. Thus, preferably, the height of the convexity 31 is set at about 10 to 100 $\mu$m.

The convexity 31 is formed on the area excluding the site where the port P3 of the center electrode 23 is arranged. The convexity 31 contacts the area which is about half the top face of the matching capacitor element C3. Similarly, for the matching capacitor elements C1 and C2, the convexities 31 having a height substantially equal to the electrode thickness of the ports P2 and P3 of the center electrodes 21 and 22 are formed in the outer periphery on the under face of the resin member 30. These convexities 31 are formed on the area excluding the sites where the ports P1 and P2 of the center electrodes 21 and 22 are provided, and contact the areas which are half the top faces of the matching capacitor elements C1 and C2, respectively. Needless to say, the convexities 31 are not necessarily formed for all the matching capacitor elements C1 to C3 as described in the first embodiment.

Referring to the above-described components, the center electrode assemblage 13, the matching capacitor elements C1 to C3, the resistance element R, and so forth are accommodated in the resin case 3 formed integrally with the lower case 4. Moreover, the resin member 30 and the permanent magnet 9 are placed thereon. Then, the upper case 8 is mounted thereon. The permanent magnet 9 applies a DC magnetic field to the center electrode assemblage 13. The lower case 4 and the upper case 8 are bonded to form a metal case, which constitutes a magnetic circuit and also functions as a yoke.

Thus, the lumped-constant isolator 1 shown in FIGS. 2 and 3 is obtained. The lumped-constant isolator 1 has a size of 4.0 mm long×4.0 mm wide×2.0 mm thick. FIG. 4 is an electrical equivalent circuit diagram of the lumped-constant isolator 1.

In the isolator 1, the convexities 31 constitute steps S (see FIG. 3) which have a height g substantially equal to the electrode thickness of the ports P1 to P3, respectively. Accordingly, the top faces of the matching capacitor elements C1 to C3 can come into contact with the ports P1 to P3 of the center electrodes 21 to 23 and also the under face of the resin member 30. Accordingly, the pressure applied when the permanent magnet 9 is mounted and the upper case 8 is made to cover is divided into pressures applied to the matching capacitor elements C1 to C3 via the ports P1 to P3 and pressures applied from the convexities 31 directly to the matching capacitor elements C1 to C3, respectively. That is, the pressure is dispersed and is wholly applied to all the matching capacitor elements C1 to C3. On the other hand, the pressure transmitted to the resistance element R via the port P3 is reduced. As a result, breaking of the resistance element R and the matching capacitor elements C1 to C3 can be prevented. Thus, the isolator 1 having a structure in which the assembly and handling can be easily performed, and also having a high reliability and a low cost can be provided.

Figure 5:
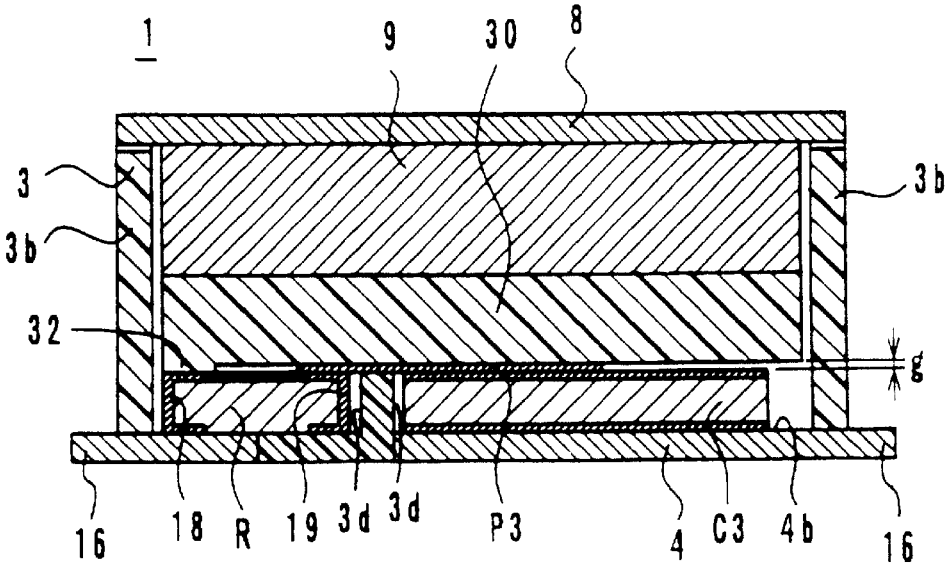
FIG. 5 is a vertical cross-sectional view of a modification of the irreversible circuit component shown in FIG. 1.
Figure 6:
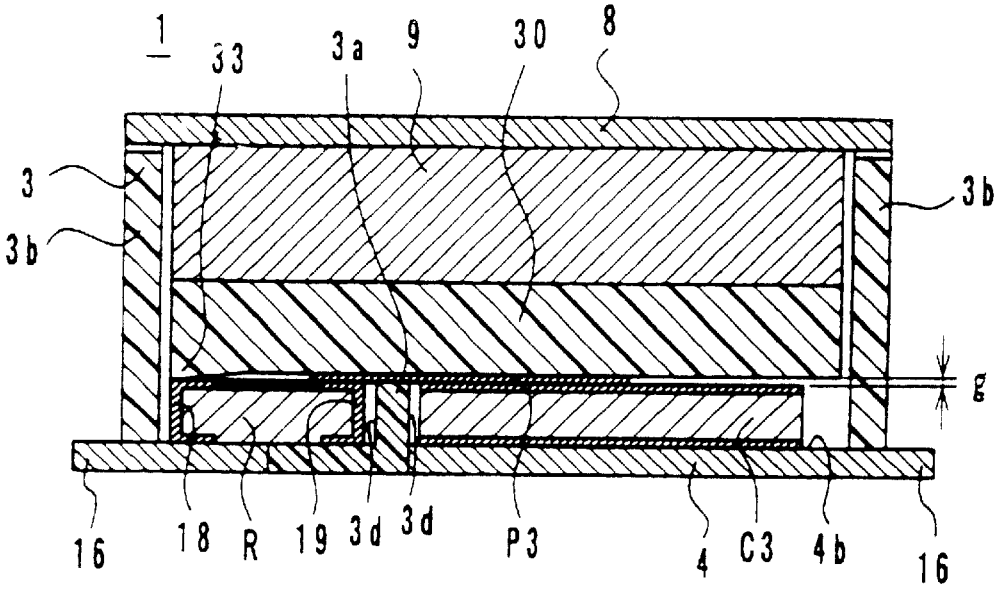
FIG. 6 is a vertical cross-sectional view of another modification of the irreversible circuit component shown in FIG. 1.

For the isolator 1, further different modifications are possible. For example, as shown in FIG. 5, a convexity 32 may be formed on the outer periphery of the under face of the resin member 30 so as to contact the left-side area of the top face of the resistance element R. The height of the resistance element R is set to be substantially equal to the electrode thickness of the port P3 of the center electrode 23. The convexity 32 forms a step having a height g substantially equal to the electrode thickness of the port P3. Thus, the convexity 32 comes into contact with the top face on the ground terminal electrode 18 side of the resistance element R. The pressure applied during the assembly process is divided into the pressure applied to the terminal electrode 19 on the high temperature side of the resistance element R via the port P3 and the pressure applied from the convexity 32 of the resin member 30 directly to the ground terminal electrode 18. That is, the pressure is dispersed and applied to the terminal electrodes 18 and 19 on the opposite sides of the resistance element R. Therefore, there is not caused such a problem that the ground terminal electrode 210 of the conventional isolator 200 is lifted from the lower case, which causes unsuitable opening of the isolator 200. Moreover, since the pressure is dispersed and applied to both of the terminals on the right and left sides of the resistance element R, breaking of the resistance element R and the matching capacitor element C3 can be prevented. The shape of the convexity is not limited to the step. A tapered convexity 33 shown in FIG. 6, a semi-spherical shape, and an arch-shape in the vertical cross-section may be employed. Other shapes may be available, provided that they have a different in height corresponding to the thickness of the center electrodes.

Figure 7:
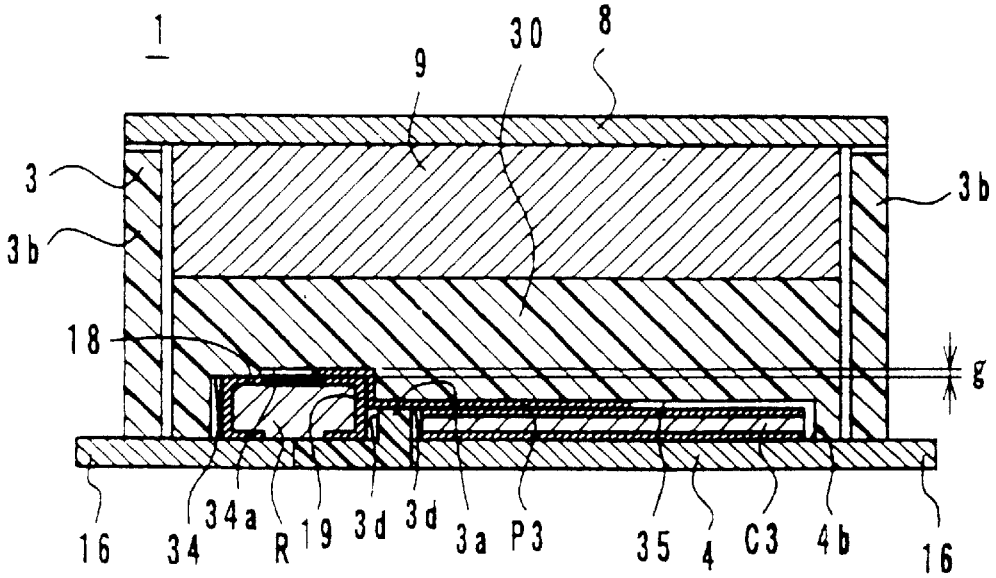
FIG. 7 is a vertical cross-sectional view of still another modification of the irreversible circuit component shown in FIG. 1.

Moreover, as shown in FIG. 7, a concavity 34 having such a size and shape as to hold the whole of the resistance element R, without substantial clearance, and also, a concavity 35, in contact with the concavity 34, having such a size and shape as to hold the whole of the matching capacitor element C3 without substantial clearance, may be formed. In the bottom of the concavity 34, a concave portion 34*a* is formed so as to have a depth substantially equal to the electrode thickness of the port P3 of the center electrode 23. The concavity 34 accommodates the resistance element R. The edge portion of the port P3 is bent so as to extend along the inner V wall of the concavity 34 and be accommodated in the concave hole 34*a*. The concavity 35 accommodates the matching capacitor element C3. The sizes of the concavities 34 and 35 are set so that they can wholly cover the resistance element R and the matching capacitor element C3. However, the concavities 34 and 35 do not necessarily cover the whole of the resistance element R and the matching capacitor element C3, respectively, and may be sized so as to cover a part of the resistance element R and so forth.

The concavity 34 positions the resistance element R and moreover the electrical connection site between the resistance element R and the port P3. Thus, the assembly can be easily performed. The concave portion 34*a* formed in the bottom of the concavity 34 defines a difference in height g which is substantially equal to the electrode thickness of the port P3. Accordingly, the top face near the ground-side terminal electrode 18 of the resistance element R comes into contact with the bottom surface of the concavity 34, and the top face near the high temperature side terminal electrode 19 contacts the port P3. Accordingly, the pressure used when the assembly is carried out is dispersed and applied to the terminal electrodes 18 and 19 on both of the right and left sides of the resistance element R. This eliminates unsuitable opening and breaking of the isolator 1. On the other hand, the pressure transmitted to the matching capacitor element C3 via the port P3 is reduced, which prevents the matching capacitor element C3 from being broken.

Moreover, the resistance element R and the matching capacitor element C3, being different in thickness, are accommodated in the concavities 34 and 35. Thus, the resistance element R and the matching capacitor element C3 can be securely pressed by the resin member 30. When the resistance element R and so forth are soldered, a so-called chip-rising phenomenon can be prevented. Furthermore, since the pressure is prevented from concentrating on the resistance element R having a relatively large thickness (because the pressure is dispersed and also applied onto the matching capacitor element C3), breaking of the resistance element R can be prevented.

Figure 8:
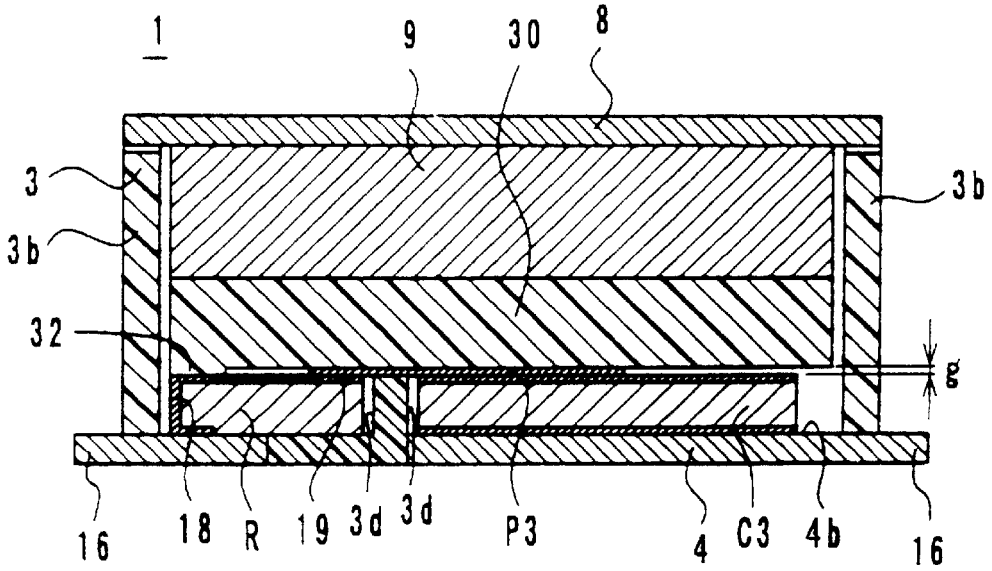
FIG. 8 is a vertical cross-sectional view of yet another modification of the irreversible circuit component shown in FIG. 1.

Moreover, as shown in FIG. 8, the isolator 1 may have the same shape as that of the islator 1 shown in FIG. 7 except that the side walls of the concavities 34 and 35 of the resin member 30 are omitted.

Figure 11:
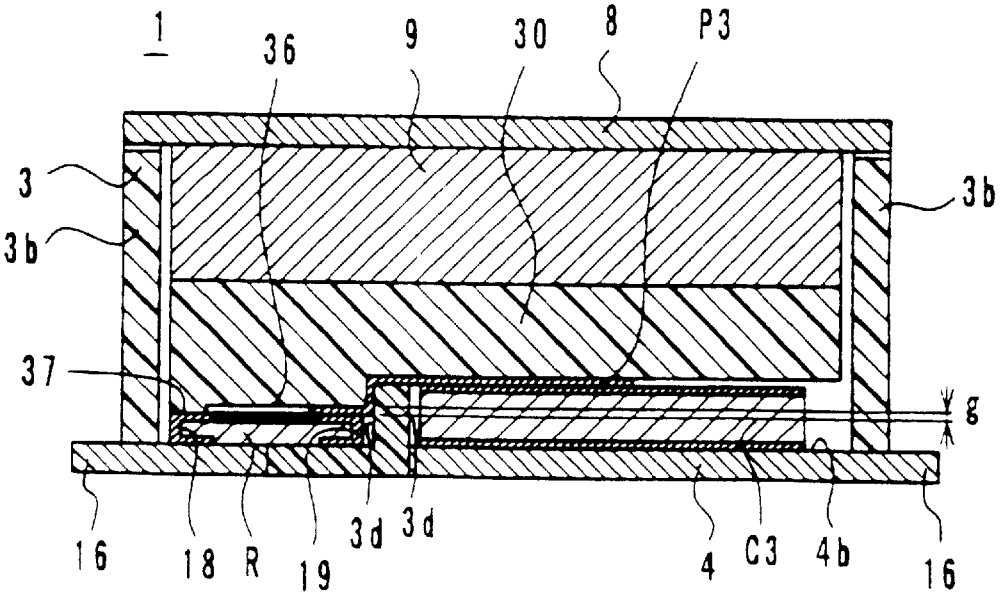
FIG. 11 is a vertical cross-sectional view of an irreversible circuit component according to a second embodiment of the present invention.

Furthermore, as shown in FIG. 11, if the resistance element R and the matching capacitor element C3 are different in thickness, a convexity 36 sized so as to cover the whole resistance element R having a relatively small thickness may be provided on the under face of the resin member 30. A convex portion 37 having a height substantially equal to the electrode height of the port P3 of the center electrode 23 is provided on the surface of the convexity 36. The edge-portion of the port P3 is bent so as to extend along the side wall of the convexity 36 and be arranged on the surface of the convexity 36. Thereby, the resistance element R and the matching capacitor element C3, which are different in thickness, can be securely pressed by the resin member 30. When the resistance element R and so forth are soldered, a so-called chip-rising phenomenon can be prevented. Furthermore, since the pressure is prevented from concentrating on the matching capacitor element C3 having a relatively large thickness, breaking of the matching capacitor element C3 can be prevented.

Furthermore, the convex portion 37 defines a difference in height substantially equal to the electrode thickness of the port P3 on the under face of the resin member 30. The convexity 37 comes into contact with the top face near the ground-side terminal electrode 18 of the resistance element R, while the top face near the high temperature terminal electrode 19 contacts the port P3. Accordingly, the pressure used for the assembly is dispersed and applied to the terminal electrodes 18 and 19 on both the right and left ends of the resistance element R. This prevents unsuitable opening and breaking of the isolator 1. Moreover, the pressure transmitted to the matching capacitor element C3 via the port P3 is reduced, which prevents the matching capacitor element C3 from being broken.

Figure 10:
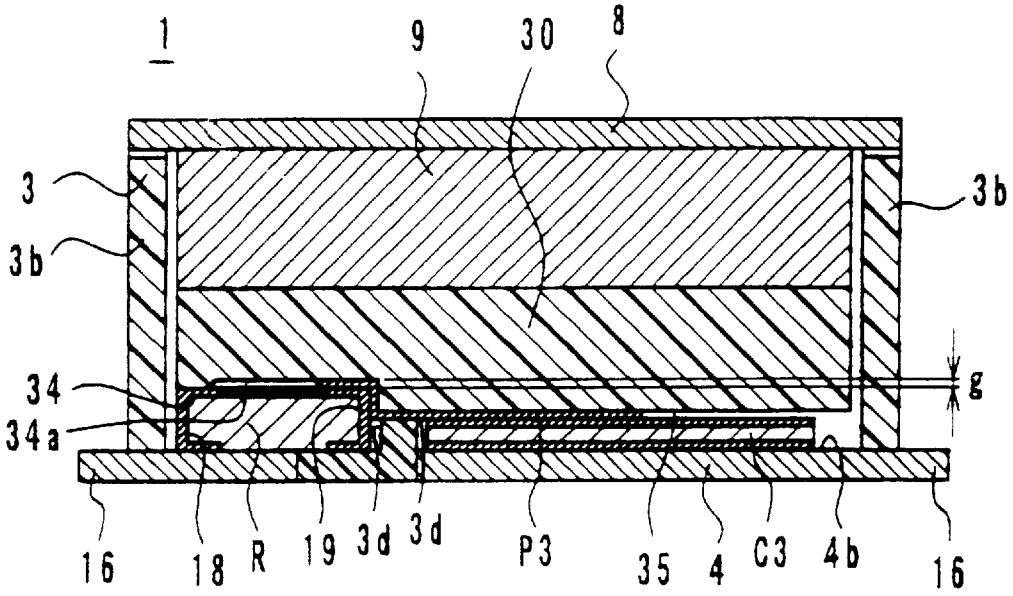
FIG. 10 is a vertical cross-sectional view of still another modification of the irreversible circuit component shown in FIG. 1.

Referring to the electrode structures of the inner components in the first embodiment, the U-shaped electrodes formed on both the ends of the resistance element R, and the electrodes formed on the top and under faces of the matching capacitor elements C1 to C3 are described. Needless to say, these electrode structures are not restrictive. For example, as shown in FIG. 10, the terminal electrode 19 on the high temperature side of the resistance element R may be formed only on the top face of the resistance element R, and the terminal electrode 18 on the ground side may be formed so as to have a U-shape. That is, it is required that the electrodes for connection to the center electrode are formed on at least a part of the top faces of the inner components. The shapes of the electrodes are optional.

Second Embodiment

Figure 9:
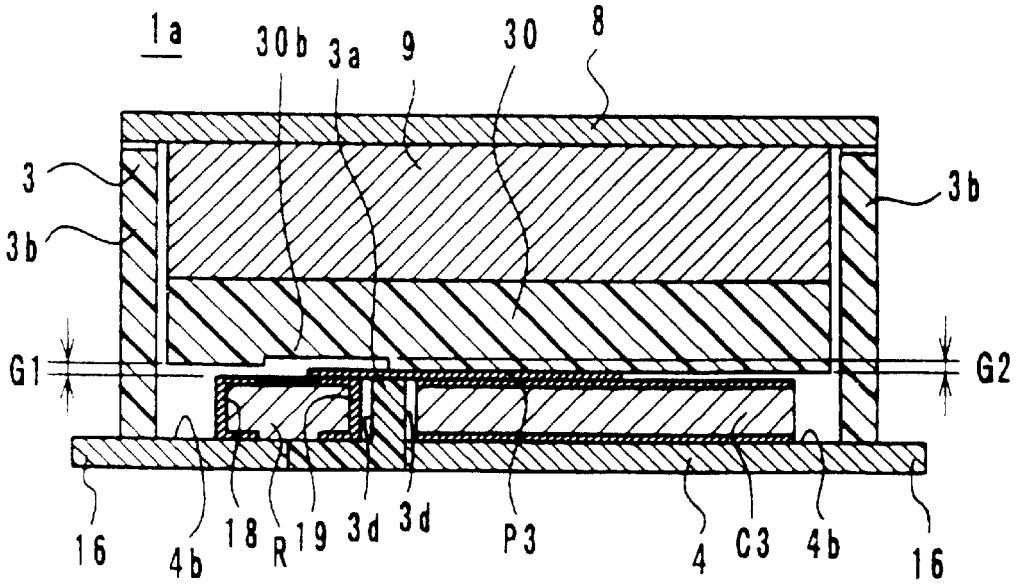
FIG. 9 is a vertical cross-sectional view of another modification of the irreversible circuit component shown in FIG. 1.

FIG. 9 is a vertical cross-sectional view of an irreversible circuit component according to another embodiment of the present invention. The lumped-constant isolator 1*a* of the second embodiment has substantially the same structure as the above-described lumped-constant isolator 1 of the first embodiment. In particular, the isolator 1*a* shown in FIG. 9 is substantially the same as the isolator 1 shown in FIG. 5 except that the step height of the convexity 32 of the resin member 30 shown in FIG. 5 is decreased by a size G1, and moreover, the depth of the portion 30*b*, lying over the resistance element R, of the resin member 30 applicable to press the electrode, is increased by a size G2.

In the isolator 1*a*, the inner components such as the resistance element R and the matching capacitor elements C1 to C3 are soldered to the lower case 4 as shown in FIG. 11. Ordinarily, for isolators having a size of 7 mm long×7 mm wide or smaller, the thickness of solder paste is about 200 $\mu$m. As materials for the solder paste, Sn—Sb type, Sn—Pb type, and Sn—Ag type solders are used. Specially, it is preferred that the Sn—Sb type solder, which is a non-lead type solder having a high melting point, is used for the standpoint of the prevention of environmental contamination and the melting workability of the irreversible circuit component 1.

In general, in the case in which solder is employed for electrical connection of the inner components of the isolator, the solder melting process is carried out to melt the solder past for bonding, after all the components for the isolator are mounted. For this reason, when the permanent magnet and the upper case are mounted, the pressure is ready to concentrate on the area where the solder past is applied. This is because this area is thicker than the other area by the thickness of the coated solder paste.

Therefore, in the isolator 1*a*, the step height of the convexity 32 on the under face of the resin member 30 is decreased by a size G1 which is equal to the thickness of the solder paste, and moreover, the depth of the portion 30*b*, lying over the resistance element R, of the resin member 30 is increased by a size G2 which is equal to the thickness of the solder paste 60. Preferably, the sizes are set at about 200 $\mu$m. In the second embodiment, the sizes G1 and G2 are set at 200 $\mu$m. Thereby, the pressure can be prevented from concentrating on the resistance element R and the port P3. Thus, breaking of the resistance element R and the matching capacitor element C3 can be prevented.

Since the sized G1 and G2 are set at 200 μm, respectively, the resistance element R and the port P3 on the matching capacitor element C3, which are arranged on the top face of the lower case 4, are pressed by the convexity 32 of the resin member 30 before the solder is melted. Thus, when the solder paste 60 is melted, the "tombstone" or "chip-rising" phenomenon is prevented. According to this phenomenon, when a chip is connected to a circuit board by solder at two solder joints and is then heated, the chip can come loose from one of the solder joints and rotate into a position standing vertically upon the other solder joint. This phenomenon is believed to occur because of a difference in surface tension between the two solder joints when melted. Unsuitable opening of the isolator 1*a,* due to such chip-rising of the resistance element R, can be prevented. Accordingly, the isolator 1*a* having a structure facilitating assembly and handling, of which the reliability is high and the cost is low can be provided.

Figure 12:
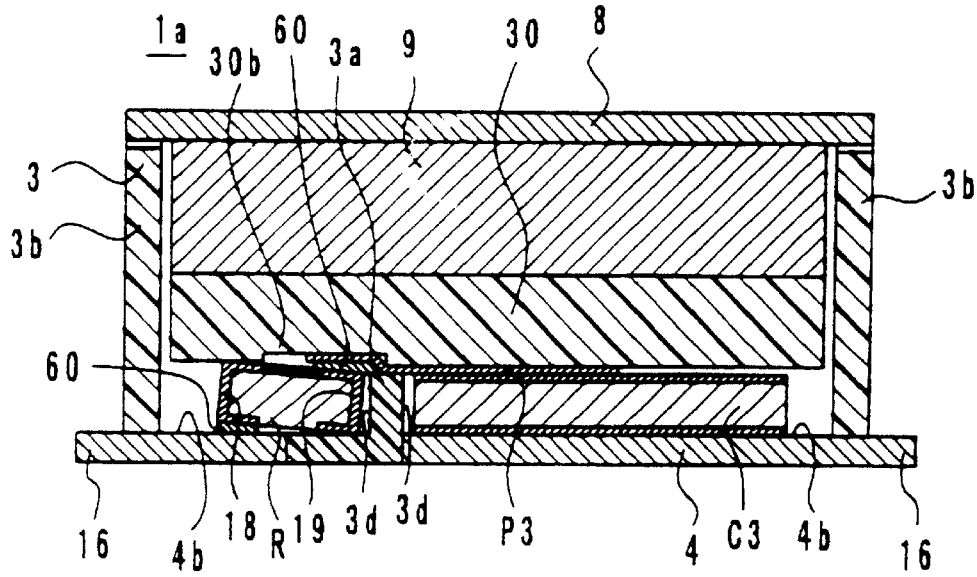
FIG. 12 is a vertical cross-sectional view showing the manufacturing procedures for the irreversible circuit component shown in FIG. 11.

Referring to the isolator 1*a* having the above-described structure, the inside of the metal case when the resistance element R and the port P3 are soldered will be described with reference to FIG. 12.

The solder paste 60 is applied to the predetermined sites for the lower case 4 and the resistance element R. The resistance element R and the port P3 are mounted on the sites. Moreover, the resin member 30, the permanent magnet 9, the upper case 8, and so forth are placed thereon. The isolator 1*a* is melting-processed, whereby the solder paste 60 is temporarily melted, and the resistance element R and the port P3 are soldered.

Ordinarily used solder paste contains a solder metal and flux in half of the amount of the paste, respectively. The flux is gasified at melting of the solder. Thus, the volume of the solder after it is melted becomes half or less of the amount of the solder before the melting. As a result, the thickness of the solder after the melting becomes half or less of the thickness of the solder before the melting, and the positions of the top faces of the resistance element R and the port P3 lower corresponding to the reduction in volume of the solder. Practically, the resistance element R itself sinks into the meted solder, due to the self-weight. Accordingly, the position of the top face of the resistance element R further lowers. As a result, gaps G1 and G2 are generated between the top faces of the resistance element R and the port P3 and the resin member 30, as shown in FIG. 9.

Third Embodiment

As a communication device according to a third embodiment of the present invention, a portable telephone as an example will be described.

Figure 13:
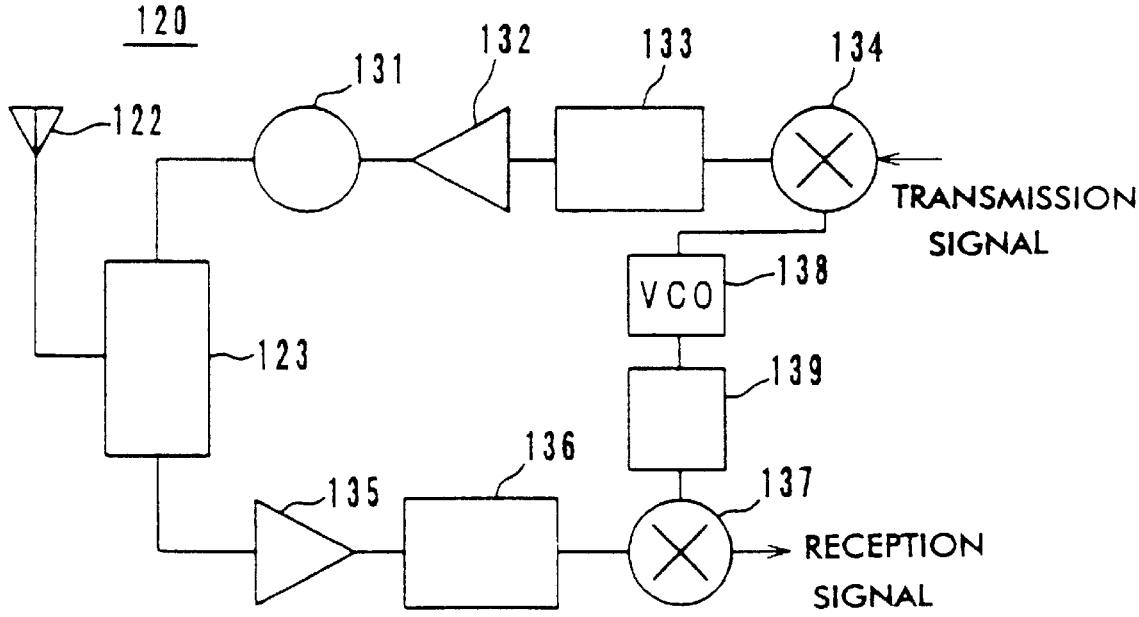
FIG. 13 is a block diagram of a communication device according to a third embodiment of the present invention.
Figure 14:
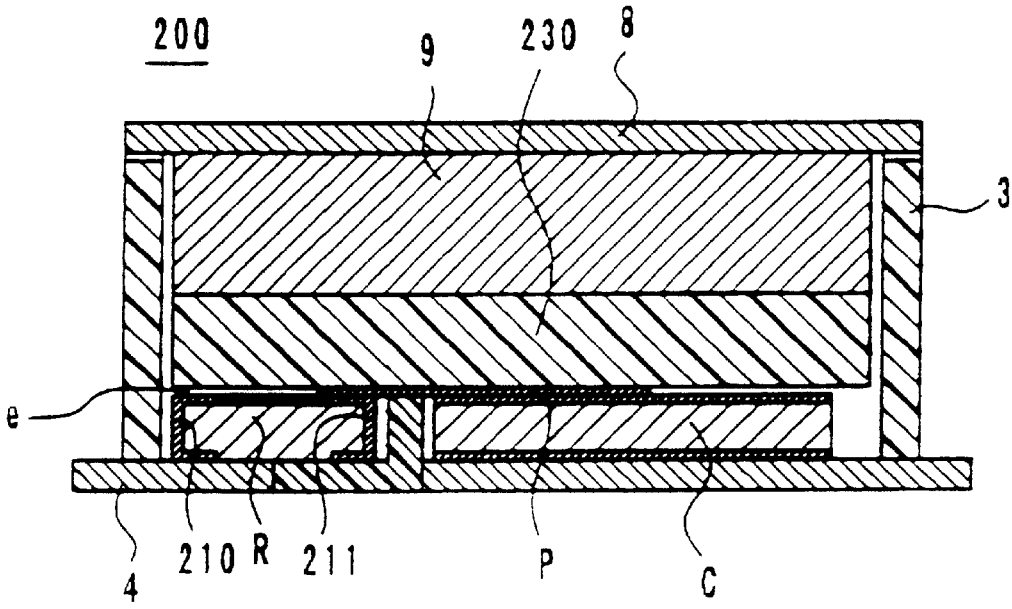
FIG. 14 PRIOR ART
FIG. 14 is a vertical cross-sectional view of a conventional irreversible circuit component.

FIG. 13 is an electric circuit block diagram of the RF part of a portable telephone 120. In FIG. 13, an antenna element 122, a duplexer 123, a transmission-side isolator 131, a reception-side amplifier 132, a transmission-side inter-stage band pass filter 133, a transmission-side mixer 134, a reception-side mixer 135, a reception-side inter-stage band pass filter 136, a reception-side mixer 137, a voltage control oscillator 138 (VCO), and a local band pass filter 139 are shown.

As the transmission-side isolator 131, the lumped-constant isolator 1 or 1*a* may be used. A portable telephone of which the cost is low and the reliability is high can be realized by the use of the lumped-constant isolator 1 or 1*a*.

The present invention is not limited to the above-described embodiments. Various changes in the structure may be resorted to without departing from the spirit of the invention. For example, the above-described embodiments deal with the isolators. It is needless to say that the present invention may be applied to a circulator and moreover other high frequency parts. Furthermore, the center electrodes are formed by punching a metal sheet, and bending. In addition, the center electrodes may be formed by providing a patterned electrode on a substrate (a dielectric substrate, a magnetic substrate, a laminated substrate, or the like). Moreover, the intersecting angles of the center electrodes may be in the range of 110 to 140°. The metal case may be divided into at least three parts. The ferrite is not limited to the rectangular parallelepiped shape, and may have another shape such as a disk or hexagonal shape.

As seen in the above description, according to the present invention, the step of which the size is substantially equal to the thickness of the center electrodes connected to the inner components are provided on the main face near the inner components of the resin member. Therefore, the top faces of the inner components can contact not only the center electrodes but also the main face of the resin member. Accordingly, the pressure used for mounting of the permanent magnet and covering of the metal case is divided into the pressure applied to the inner components via the center electrodes and the pressure applied directly from the resin member to the inner components. As a result, the pressure is dispersed and transmitted to the whole of the inner components. This is effective in preventing the inner components from being broken. The irreversible circuit component which has a structure easy to be assembled and handled and of which the reliability is high, and the cost is low can be provided.

The communication device in accordance with the present invention includes the irreversible circuit component having the above-described characteristics. Thus, the cost of the communication device is low, and the reliability is high.

What is claimed is:

1. An irreversible circuit component comprising:

a permanent magnet;

a ferrite to which the permanent magnet applies a DC magnetic field;

plural center electrodes arranged on the ferrite;

an internal component;

a resin member arranged between the permanent magnet and the internal component; and a metal case accommodating the permanent magnet, the ferrite, the center electrodes, the resin member, and the internal component, the internal component and the center electrodes being electrically connected to each other on the top face of the internal component, the main face near the internal component of the resin member being provided with a convexity of which the size is substantially equal to the thickness of the center electrodes electrically connected to the internal component.

2. An irreversible circuit component according to claim 1, wherein the size of the convexity is in the range of 10 μm to 100 μm.

3. An irreversible circuit component according to claim 1, wherein a part of the under face of the internal component contacts the inner wall of a resin case formed integrally with the metal case.

4. An irreversible circuit component according to claim 1, wherein the main face near the internal component of the resin member is provided with a concavity of which the size is such that the concavity can cover at least a part of the internal component.

5. An irreversible circuit component according to claim 1, wherein the internal component is electrically connected to the center electrodes via solder.

6. An irreversible circuit component according to claim 1, wherein the distance in the thickness direction of the resin member between the internal component and the resin member is up to 200 $\mu$m, and the distance in the thickness direction of the resin member between the center electrodes and the resin member is up to 200 $\mu$m.

7. An irreversible circuit component according to claim 1, wherein the resin member is made of a material selected from the group consisting of a liquid crystal polymer and PPS.

8. A communication device comprising a high-frequency circuit, said circuit including at least one irreversible circuit component, said component comprising:

a permanent magnet;

a ferrite to which the permanent magnet applies a DC magnetic field;

plural center electrodes arranged on the ferrite;

an internal component;

a resin member arranged between the permanent magnet and the internal component; and a metal case accommodating the permanent magnet, the ferrite, the center electrodes, the resin member, and the internal component, the internal component and the center electrodes being electrically connected to each other on the top face of the internal component, the main face near the internal component of the resin member being provided with a convexity of which the size is substantially equal to the thickness of the center electrodes electrically connected to the internal component.

9. A communication device according to claim 8, wherein the size of the convexity is in the range of 10 $\mu$m 100 $\mu$m.

10. A communication device according to claim 8, wherein a part of the under face of the internal component contacts the inner wall of a resin case formed integrally with the metal case.

11. A communication device according to claim 8, wherein the main face near the internal component of the resin member is provided with a concavity of which the size is such that the concavity can cover at least a part of the internal component.

12. A communication device according to claim 8, wherein the internal component is electrically connected to the center electrodes via solder.

13. A communication device according to claim 8, wherein the distance in the thickness direction of the resin member between the internal component and the resin member is up to 200 $\mu$m, and the distance in the thickness direction of the resin member between the center electrodes and the resin member is up to 200 $\mu$m.

14. A communication device according to claim 8, wherein the resin member is made of a material selected from the group consisting of a liquid crystal polymer and PPS.

* * * * *